US012138737B2

(12) United States Patent
Islam

(10) Patent No.: US 12,138,737 B2
(45) Date of Patent: Nov. 12, 2024

(54) CMP POLISHING PAD WITH ENHANCED RATE

(71) Applicant: Rohm and Haas Electronic Materials CMP Holdings, Inc., Newark, DE (US)

(72) Inventor: Mohammad T. Islam, Middletown, DE (US)

(73) Assignee: Rohm and Haas Electronic Materials Holdings, Inc., Newark, DE (US)

( * ) Notice: Subject to any disclaimer, the term of this patent is extended or adjusted under 35 U.S.C. 154(b) by 270 days.

(21) Appl. No.: 17/218,716

(22) Filed: Mar. 31, 2021

(65) Prior Publication Data

US 2022/0314392 A1 Oct. 6, 2022

(51) Int. Cl.
*B24B 37/24* (2012.01)
*B24B 37/04* (2012.01)

(52) U.S. Cl.
CPC ..... *B24B 37/24* (2013.01); *B24B 37/042* (2013.01)

(58) Field of Classification Search
CPC ..... B24B 7/228; B24B 57/02; B24B 37/042; B24B 37/044; B24B 37/20; B24B 37/22; B24B 37/24; B24B 37/245
See application file for complete search history.

(56) References Cited

U.S. PATENT DOCUMENTS

| | | | | |
|---|---|---|---|---|
| 6,858,174 | B2 * | 2/2005 | Nair | C04B 35/6309 264/234 |
| 8,083,820 | B2 * | 12/2011 | Kollodge | C09K 3/1409 428/688 |
| 9,390,938 | B2 | 7/2016 | Yoshizaki | |
| 10,391,606 | B2 * | 8/2019 | Weis | B24B 37/24 |

FOREIGN PATENT DOCUMENTS

| | | | | |
|---|---|---|---|---|
| CN | 110951402 A | * | 4/2020 | |
| JP | 3950491 B | | 4/2007 | |
| JP | 2008066588 | | 3/2008 | |
| JP | 2013157580 | | 8/2013 | |
| JP | 2014069260 | | 4/2014 | |
| TW | 201718818 A | * | 6/2017 | B24B 37/24 |

OTHER PUBLICATIONS

Machine translation of TW-201718818-A (Year: 2017).*
Machine translation of CN-110951402-A (Year: 2020).*

* cited by examiner

*Primary Examiner* — Robert F Neibaur
(74) *Attorney, Agent, or Firm* — Blake T. Biederman

(57) ABSTRACT

A polishing pad having a polishing portion comprising a polymer matrix and rate enhancing lamellar particles that include a phosphate or an arsenate of group III-A or group IV-A metals can be effective in chemical mechanical polishing especially when using a slurry comprising particles having a positive charge in slurry conditions.

8 Claims, 1 Drawing Sheet

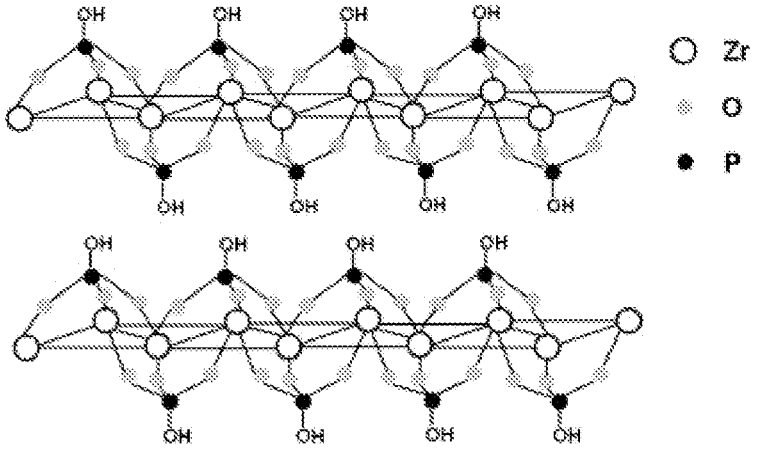
OH
Zr
O
P

CMP POLISHING PAD WITH ENHANCED RATE

FIELD OF THE INVENTION

The present invention relates generally to polishing pads for chemical mechanical polishing of substrates, including particularly polishing using ceria-based slurry such as during formation of pre-metal dielectric.

BACKGROUND

In the fabrication of integrated circuits and other electronic devices, multiple layers of conducting, semiconducting and dielectric materials are deposited onto and partially or selectively removed from a surface of a semiconductor wafer. Thin layers of conducting, semiconducting and dielectric materials may be deposited using a number of deposition techniques. In addition, in damascene processes a material is deposited to fill recessed areas created by patterned etching of trenches and vias. As the filling is conformal this can lead to irregular surface topography. Also, to avoid underfilling extra material can be deposited. Thus, material outside the recesses needs to be removed. Common deposition techniques in modern wafer processing include physical vapor deposition (PVD), also known as sputtering, chemical vapor deposition (CVD), plasma-enhanced chemical vapor deposition (PECVD) and electrochemical deposition (ECD), among others. Common removal techniques include wet and dry etching; isotropic and anisotropic etching, among others.

As materials are sequentially deposited and removed, the topography of the substrate can become non-uniform or non-planar. Because subsequent semiconductor processing (e.g., photolithography, metallization, etc.) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, also referred to as chemical mechanical polishing (CMP), is a common technique used to planarize or polish workpieces such as semiconductor wafers and to remove excess material in damascene processes, front end of line (FEOL) processes or back end of line (BEOL) processes. In conventional CMP, a wafer carrier, or polishing head, is mounted on a carrier assembly. The polishing head holds the wafer and positions the wafer in contact with a polishing surface of a polishing pad that is mounted on a table or platen within a CMP apparatus. The carrier assembly provides a controllable pressure between the wafer and polishing pad. Simultaneously, a slurry or other polishing medium is dispensed onto the polishing pad and is drawn into the gap between the wafer and polishing layer. To effect polishing, the polishing pad and wafer typically rotate relative to one another. As the polishing pad rotates beneath the wafer, the wafer traverses a typically annular polishing track, or polishing region, wherein the wafer's surface directly confronts the polishing layer. The wafer surface is polished and made planar by chemical and mechanical action of the polishing surface and polishing medium (e.g., slurry) on the surface.

Removal rate is important to efficiency of the process of making the electronic device. For example, in high capacity multiple layer memory devices (e.g., 3D NAND flash memory) the manufacturing process can include building up multilayer stacks of $SiO_2$ and $Si_3N_4$ films in an alternating fashion in a pyramidal staircase fashion. Once completed, the stack is capped with a thick $SiO_2$ overlayer. This must be planarized prior to completion of the device structure. The device capacity is proportional to the number of layers in the layered stack. Commercial devices generally use 32 or 64 layers, and the industry is rapidly moving to 128 layers. The thickness of each oxide/nitride pair in the stack is about 125 nm. Thus, the thickness of the stack increases directly with the number of layers (32 layers having a thickness of about 4,000 nm, 64 layers having a thickness of about 8,000 nm, 128 layers having a thickness of about 16,000 nm). The total amount of capping dielectric to be removed can be about 1.5 times the stack thickness (e.g. up to about 24,000 nm). Conventional dielectric CMP slurries have removal rates of about 250 nm/min leading to undesirably lengthy CMP process times, which can create a bottleneck in the 3D NAND manufacturing process. Much work on developing faster CMP processes have focused on process conditions—e.g. higher pressure, higher speeds of contact, pad conditioning, slurry compositions. However, improving removal rate cannot be at the expense of increased defectivity in the polished substrate. Thus, means of improving removal rate, preferably, while not increasing defects is desired.

SUMMARY OF THE INVENTION

Disclosed herein is a polishing pad useful in chemical mechanical polishing having a polishing material comprising a polymeric matrix material; and lamellar particles for enhancing polishing rate, the lamellar particles including a hydrogenphosphate or hydrogenarsenate of a group III-A or Group IV-A metal, preferably of the formula $$M(HYO_4)_2n(H_2O),$$

where M is a group III-A or group IV-A metal ion, preferably $Zr^{+4}$, $Ti^{+4}$ or $Ce^{+4}$, most preferably $Zr^{+4}$, Y is P or As, preferably P, and n is 0, 1, or 2, preferably 1.

Also disclosed herein is a method comprising providing a substrate, providing a polishing pad as described above, providing a slurry between the polishing pad and the substrate, polishing the substrate with the pad and slurry, preferably wherein the polishing occurs at a pH at which the slurry comprises particles that collectively have positive surface charge in an aqueous medium such as deionized water. For purposes of this specification, positive surface charge means that the pH of the polishing slurry is below its isoelectric point.

BRIEF DESCRIPTION OF THE DRAWINGS

FIG. 1 is a schematic showing a chemical structure of one example of a rate enhancing lamellar particle additive as disclosed herein.

DETAILED DESCRIPTION OF THE INVENTION

Disclosed herein is a polishing pad having a polishing portion comprising a polymer matrix and rate enhancing lamellar particles.

The rate enhancing lamellar particles can be a metal hydrogen phosphate or a metal hydrogen arsenate. The rate enhancing lamellar particles can have a layered structure. Without wishing to be bound, it is postulated that the layered structure may reduce the likelihood of large particles, which can scratch and form defects in the substrate which is to be polished. The rate enhancing lamellar particles can have a platelet structure (particularly, a layered platelet structure). The average dimension of the particle in the major direction (i.e. length and/or width, substantially perpendicular to thickness) can be at least 0.5, or at least 1 microns, or at least 2 microns and at the same time can be up to 20, or up to 10, or up to 5 microns. The particle can have an aspect ratio (length or width: thickness) of 3 to 20 or 3 to 10.

The rate enhancing lamellar particles can have a crystalline structure. FIG. 1 illustrates an example of the molecular structure of such lamellar particles showing zirconium as the metal and phosphate groups. Each layer can have a plane of metal ions associated with (e.g. bridged by) hydrogen phosphate (or arsenate) groups above and below the metal ion plane. The outer surface of the hydrogen phosphate (or arsenate) bridging layers can be terminated by a P—OH group (or an As—OH group). A metal ion, $Zr^{+4}$ is shown, can be associated with phosphate or arsenate groups (phosphate groups are shown), preferably phosphate, on either side forming an alternating or lamellar structure. Water can associate with the hydroxyl groups. The metal ion can be a group III-A or Group IV-A metal ion, such as a zirconium ion (e.g. $Zr^{+4}$), a titanium ion (e.g. $Ti^{+4}$), or a cerium ion (e.g. $Ce^{+4}$).

The particles can have several layers of the metal ion (e.g. $Zr^{+4}$), typically in the form of metal oxides and associated phosphate groups (or arsenate groups). Above the isoelectric pH (around 3 for zirconium hydrogen phosphate) in aqueous solution the surface is highly negative due to the large number of surface hydroxyl groups. The particles are also hydrophilic, but chemically inert and insoluble in water. The particles can be highly friable such that large particles are unlikely to produce scratch defects when polishing. Furthermore, these particles can cleave to form platelets that can improve polishing performance, such as by increasing removal rate.

The metal phosphate or metal arsenate can have the formula $$M(HYO_4)_2n(H_2O),$$

where M is a group III-A or group IV-A metal ion, preferably $Zr^{+4}$, $Ti^{+4}$ or $Ce^{+4}$, most preferably $Zr^{+4}$, Y is P or As, preferably P, and n is 0, 1, or 2, preferably 1.

The amount of the rate enhancing lamellar particles as disclosed herein used in the polishing portion of the pad can be at least 0.1, or at least 1, or at least 2, or at least 3, or at least 5 and up to up to 20, or up to 15 or up to 10 weight percent based on total weight of the polishing portion. The amount of the rate enhancing lamellar particles can be 0.1 to 20 volume percent, or 1 to 18 volume percent, or 2 to 15 volume percent based on total volume of the polishing portion.

The polishing portion can comprise any polymeric matrix material commonly used in polishing pads. The polishing portion can comprise thermoplastic or thermoset polymers. Examples of polymers that can be used in the polishing portion in polymeric materials that can be used in the base pad or polishing portion include polycarbonates, polysulfones, nylons, epoxy resins, polyethers, polyesters, polystyrenes, acrylic polymers, polymethyl methacrylates, polyvinylchlorides, polyvinyl fluorides, polyethylenes, polypropylenes, polybutadienes, polyethylene imines, polyurethanes, polyether sulfones, polyamides, polyether imides, polyketones, epoxies, silicones, copolymers thereof (such as, polyether-polyester copolymers), and combinations or blends thereof. The polymer can be a polyurethane.

The polishing portion can have Young's modulus of according to ASTM D412-16 of at least 2, at least 2.5, at least 5, at least 10, or at least 50 MPa up to 900, up to 700, up to 600, up to 500, up to 400, up to 300, or up to 200 MPa The polishing portion can be opaque to the signal being used for endpoint detection.

The polishing portion can also include other particles. For instant, such as, particularly hollow microelements, particularly, flexible hollow polymeric microelements—e.g, microspheres. For example, a plurality of microelements can be uniformly dispersed throughout the polishing layer. The plurality of microelements can be simply pores in the matrix (e.g. entrapped gas bubbles), or can be hollow core polymeric materials, liquid filled hollow core polymeric materials, water soluble materials or an insoluble phase material (e.g., mineral oil). The plurality of microelements provide porosity to the polishing element, as for example, when the microelement is selected from entrapped gas bubbles and hollow core polymeric materials uniformly distributed throughout the polishing layer. The microelements can have a weight average diameter of up to 150 microns or up to 50 microns, while having a diameter of at least 10 microns. Weight average diameter can be measured using laser diffraction—e.g. low angle laser light scattering (LALLS). The plurality of microelements can comprise polymeric microballoons with shell walls of either polyacrylonitrile or a polyacrylonitrile copolymer (e.g., Expancel® microspheres from Akzo Nobel). The plurality of microelements can be incorporated into the polishing layer in amounts of 0, or at least 5 or at least 10 volume percent, up to 50, up to 45, up to 40, or up to 35 volume percent. Where the microelement provides porosity, the porosity of the polishing portion can be 0 to 50, 5 to 45 or 10 to 35 volume percent porosity. The volume percent of porosity can be determined by dividing the difference between the specific gravity of an unfilled polishing layer and specific gravity of the microelement containing polishing layer by the specific gravity of the unfilled polishing layer. Alternatively, the percent porosity determined by dividing the density of the polishing layer by the weighted average density of the unfilled components of the polishing layer. The metal phosphate are particularly useful for machining non-porous polishing pads. For example, the metal phosphate particles can improve machining grooves from either vertical lathes that operate with fixed cutting tools or cutting grooves with spinning tools bits.

The polishing portion can have a density of 0.4 to 1.15, or 0.7 to 1.0 g/cm$^3$ as measured according to ASTM D1622 (2014).

The polishing portion can have a Shore D hardness of 28 to 75 as measured according to ASTM D2240 (2015).

The polishing portion can have an average thickness of 20 to 150 mils, 30 to 125 mils, 40 to 120 mils, or 50 to 100 mils (0.5-4, 0.7-3, 1-3, or 1.3-2.5 mm).

The polishing pad of the present invention optionally further comprises at least one additional layer interfaced with the polishing layer. For example, the polishing pad can further comprise a compressible base layer adhered to the polishing layer. The compressible base layer preferably improves conformance of the polishing layer to the surface of the substrate being polished. The base pad (also referred to as sublayer or base layer) can be used under the polishing portion. The base pad can be a single layer or can comprise more than one layer. The top surface of the base pad can define a plane, in the x-y Cartesian coordinates. For example, the polishing portion may be attached to a base pad via mechanical fasteners or by an adhesive. The base layer can have a thickness of at least 0.5 or at least 1 mm. The base layer can have a thickness of no more than 5, no more than 3, or no more than 2 mm.

The base pad or base layer may comprise any material known for use as base layers for polishing pads. For example, it can comprise a polymer, a blend of polymers or a composite of a polymeric material with other materials, such as ceramic, glass, metal, or stone. Polymers and polymer composites can be used as the base pad, particularly for the top layer if there is more than one layer, due to compatibility with the material which can form the polishing portion. Examples of such composites include polymers filled with carbon or inorganic fillers and fibrous mats of, for example glass or carbon fibers, impregnated with a polymer. The base of the pad can be made of a material having one or more of the following properties: a Young's modulus as determined, for example, by ASTM D412-16 in the range of at least 2, at least 2.5, at least 5, at least 10, or at least 50 MPa up to 900, up to 700, up to 600, up to 500, up to 400, up to 300, or up to 200 MPa; a Poisson's ratio as determined, for example, by ASTM E132 of at least 0.05, at least 0.08, or at least 0.1 up to 0.6 or up to 0.5; a density of at least 0.4 or at least 0.5 up to 1.7, up to 1.5, or up to 1.3 grams per cubic centimeter ($g/cm^3$).

Examples of such polymeric materials that can be used in the base pad or polishing portion include polycarbonates, polysulfones, nylons, epoxy resins, polyethers, polyesters, polystyrenes, acrylic polymers, polymethyl methacrylates, polyvinylchlorides, polyvinyl fluorides, polyethylenes, polypropylenes, polybutadienes, polyethylene imines, polyurethanes, polyether sulfones, polyamides, polyether imides, polyketones, epoxies, ethylene-vinyl acetate (EVA or PEVA), ethylene propylene diene monomer rubber (EPDM rubber), silicones, copolymers thereof (such as, polyether-polyester copolymers), or combinations or blends thereof.

The polymer can be a polyurethane. The polyurethane can be used alone or can be a matrix for carbon or inorganic fillers and fibrous mats of, for example glass or carbon fibers, For purposes of this specification, "polyurethanes" are products derived from difunctional or polyfunctional isocyanates, e.g. polyetherureas, polyisocyanurates, polyurethanes, polyureas, polyurethaneureas, copolymers thereof and mixtures thereof. The CMP polishing pads may be made by methods comprising: providing the isocyanate terminated urethane prepolymer; providing separately the curative component; and combining the isocyanate terminated urethane prepolymer and the curative component to form a combination, then allowing the combination to react to form a product. It is possible to form the base pad or base layer by skiving a cast polyurethane cake to a desired thickness. Optionally, preheating a cake mold with IR radiation, induction or direct electrical current can reduce product variability when casting porous polyurethane matrices. Optionally, it is possible to use either thermoplastic or thermoset polymers. The polymer can be a crosslinked thermoset polymer.

When a polyurethane is used in the base pad and/or the polishing layer it can be the reaction product of a polyfunctional isocyanate and a polyol. For example, a polyisocyanate terminated urethane prepolymer can be used. The polyfunctional isocyanate used in the formation of the polishing layer of the chemical mechanical polishing pad of the present invention can be selected from the group consisting of an aliphatic polyfunctional isocyanate, an aromatic polyfunctional isocyanate and a mixture thereof. For example, the polyfunctional isocyanate used in the formation of the polishing layer of the chemical mechanical polishing pad of the present invention can be a diisocyanate selected from the group consisting of 2,4 toluene diisocyanate; 2,6 toluene diisocyanate; 4,4' diphenylmethane diisocyanate; naphthalene 1,5 diisocyanate; tolidine diisocyanate; para phenylene diisocyanate; xylylene diisocyanate; isophorone diisocyanate; hexamethylene diisocyanate; 4, 4' dicyclohexylmethane diisocyanate; cyclohexanediisocyanate; and, mixtures thereof. The polyfunctional isocyanate can be an isocyanate terminated urethane prepolymer formed by the reaction of a diisocyanate with a prepolymer polyol. The isocyanate terminated urethane prepolymer can have 2 to 12 wt %, 2 to 10 wt %, 4-8 wt % or 5 to 7 wt % unreacted isocyanate (NCO) groups. The prepolymer polyol used to form the polyfunctional isocyanate terminated urethane prepolymer can be selected from the group consisting of diols, polyols, polyol diols, copolymers thereof and mixtures thereof. For example, the prepolymer polyol can be selected from the group consisting of polyether polyols (e.g., poly(oxytetramethylene)glycol, poly(oxypropylene)glycol and mixtures thereof); polycarbonate polyols; polyester polyols; polycaprolactone polyols; mixtures thereof; and, mixtures thereof with one or more low molecular weight polyols selected from the group consisting of ethylene glycol; 1,2 propylene glycol; 1,3 propylene glycol; 1,2 butanediol; 1,3 butanediol; 2 methyl 1,3 propanediol; 1,4 butanediol; neopentyl glycol; 1,5 pentanediol; 3 methyl 1,5 pentanediol; 1,6 hexanediol; diethylene glycol; dipropylene glycol; and, tripropylene glycol. For example, the prepolymer polyol can be selected from the group consisting of polytetramethylene ether glycol (PTMEG); ester based polyols (such as ethylene adipates, butylene adipates); polypropylene ether glycols (PPG); polycaprolactone polyols; copolymers thereof; and, mixtures thereof. For example, the prepolymer polyol can be selected from the group consisting of PTMEG and PPG. When the prepolymer polyol is PTMEG, the isocyanate terminated urethane prepolymer can have an unreacted isocyanate (NCO) concentration of 4 to 12 wt % (more preferably of 6 to 10 wt %; most preferably 8 to 10 wt %). Examples of commercially available PTMEG based isocyanate terminated urethane prepolymers include Imuthane® prepolymers (available from COIM USA, Inc., such as, PET 80A, PET 85A, PET 90A, PET 93A, PET 95A, PET 60D, PET 70D, PET 75D); Adiprene® prepolymers (available from Chemtura, such as, LF 800A, LF 900A, LF 910A, LF 930A, LF 931A, LF 939A, LF 950A, LF 952A, LF 600D, LF 601D, LF 650D, LF 667, LF 700D, LF750D, LF751D, LF752D, LF753D and L325); Andur® prepolymers (available from Anderson Development Company, such as, 70APLF, 80APLF, 85APLF, 90APLF, 95APLF, 60DPLF, 70APLF, 75APLF). When the prepolymer polyol is PPG, the isocyanate terminated urethane prepolymer can have an unreacted isocyanate (NCO) concentration of 3 to 9 wt % (more preferably 4 to 8 wt %, most preferably 5 to 6 wt %). Examples of commercially available PPG based isocyanate terminated urethane prepolymers include Imuthane® prepolymers (available from COIM USA, Inc., such as, PPT 80A, PPT 90A, PPT 95A, PPT 65D, PPT 75D); Adiprene® prepolymers (available from Lanxess, such as, LFG 963A, LFG 964A, LFG 740D); and, Andur® prepolymers (available from Anderson Development Company, such as, 8000APLF, 9500APLF, 6500DPLF, 7501DPLF). The isocyanate terminated urethane prepolymer can be a low free isocyanate terminated urethane prepolymer having less than 0.1 wt % free toluene diisocyanate (TDI) monomer content. Non-TDI based isocyanate terminated urethane prepolymers can also be used. For example, isocyanate terminated urethane prepolymers include those formed by the reaction of 4,4' diphenylmethane diisocyanate (MDI) and polyols such as polytetramethylene glycol (PTMEG) with optional diols such as 1,4 butanediol (BDO) are acceptable. When such isocyanate terminated urethane prepolymers are used, the unreacted isocyanate (NCO) concentration is preferably 3 to 10 wt % (more preferably 4 to 10 wt %, most preferably 5 to 10 wt %). Examples of commercially available isocyanate terminated urethane prepolymers in this category include Imuthane® prepolymers (available from COIM USA, Inc. such as 27 85A, 27 90A, 27 95A); Andur® prepolymers (available from Anderson Development Company, such as, IE75AP, IE80AP, IE 85AP, IE90AP, IE95AP, IE98AP); and, Vibrathane® prepolymers (available from Chemtura, such as, B625, B635, B821).

The polishing pad of the present invention in its final form further can include the incorporation of texture of one or more dimensions on its upper surface. These may be classified by their size into macrotexture or microtexture. Common types of macrotexture employed for CMP to control hydrodynamic response and/or slurry transport, include, without limitation, grooves of many configurations and designs, such as annular, radial, and cross-hatchings. These may be formed via machining processes to a thin uniform sheet or may be directly formed on the pad surface via a net shape molding process. Common types of microtexture are finer scale features which create a population of surface asperities which are the points of contact with the substrate wafer where polishing occurs. Common types of microtexture include, without limitation, texture formed by abrasion with an array of hard particles, such as diamond (often referred to as pad conditioning), either prior to, during or after use, and microtexture formed during the pad fabrication process.

The polishing pad of the present invention can be suitable to be interfaced with a platen of a chemical mechanical polishing machine. The polishing pad can be affixed to the platen of a polishing machine. The polishing pad can be affixed to the platen using at least one of a pressure sensitive adhesive and vacuum.

The CMP pads of the present invention may be manufactured by a variety of processes that are compatible with the properties of the pad polymer being used. These include mixing the ingredients as described above and casting into a mold, annealed, and sliced into sheets of the desired thickness. Alternatively, they may be made in a more precise net shape form. Processes for manufacture include: 1. thermoset injection molding (often referred to as "reaction injection molding" or "RIM"), 2. thermoplastic or thermoset injection blow molding, 3. compression molding, or 4. any similar-type process in which a flowable material is positioned and solidified, thereby creating at least a portion of a pad's macrotexture or microtexture. In an example of molding the polishing pad: 1. the flowable material is forced into or onto a structure or substrate; 2. the structure or substrate can impart a surface texture into the material as it solidifies, and 3. the structure or substrate is thereafter separated from the solidified material.

Method

The polishing pads as disclosed here can be used to polish substrates. For example, the polishing method can include providing a substrate to be polished and then polishing using the pad disclosed herein. The substrate can be any substrate where polishing and/or planarization is desired. Examples of such substrates include magnetic, optical and semiconductor substrates. A specific example is a pre-metal dielectric stack. A specific material to be polished on the substrate can be a silicon oxide layer. The method can be part of front end of line or back end of line processing for integrated circuits. For example, the process can be used to remove undesired surface topography and surface defects, such as rough surfaces, agglomerated materials, crystal lattice damage, scratches and contaminated layers or materials. In addition, in damascene processes a material is deposited to fill recessed areas created by one or more steps of photolithography, patterned etching, and metallization. Certain steps can be imprecise—e.g. there can be overfilling of recesses. The method disclosed here can be used to remove material outside the recesses. The process can be chemical mechanical planarization or chemical mechanical polishing both of which can be referred to as CMP. A carrier can hold the substrate to be polished—e.g. a semiconductor wafer (with or without layers formed by lithography and metallization) in contact with the polishing elements of the polishing pad. A slurry or other polishing medium can be dispensed into a gap between the substrate and the polishing pad. The polishing pad and substrate are moved relative to one another—e.g. rotated. The polishing pad is typically located below the substrate to be polished. The polishing pad can be rotated. The substrate to be polished can also be moved—e.g. on a polishing track such as an annular shape. The relative movement causes the polishing pad to approach and contact the surface of the substrate.

The pads as disclosed herein can be used with any slurry. The inventors found that use of the pads as disclosed herein with a slurry having particles that are positively charged (or have positive surface charge) during polishing conditions can provide significant improvement in removal rate. Without wishing to be bound, it is postulated that the rate enhancing lamellar particles can provide a pad surface with a relatively high concentration of anionic hydroxyl sites that positively charged particles present during polishing can associate with.

The pressure of the platen can be from 1 to 5, 1.5 to 4.5, or 2 to 4 pounds per square inch (psi) (about 6-35, 10-30, or 13 to 28 kilopascals (KPa)). Speed of the platen can be about 40 to 150, or 50-130 rpm. The amount of slurry added can be, for example, 50 to 500 milliliters/minute. The pH of the slurry during polishing can be up to 7, or up to 6.8 and as low as 2, 2.5, or 3.

For example, a benefit in improvement in removal rate is particularly noticeable in ceria-based slurries. In ceria based slurries, the $CeO_2$ can cause the particles to have a positive charge (or positive surface charge) at pH below about 6.5, For example, such ceria based slurries can comprise at least 0.01, or at least 0.1, weight percent ceria particles up to 20, or up to 15, or up to 10, or up to 5 or up to 2 weight percent ceria particles based on total weight of the slurry. The ceria based-slurry can comprise only ceria as the sole particle or can also comprise additional other particles. These other particles can be, for example, other particles that have a positive (surface) charge at the pH at which polishing occurs. The other particles can be, for example, silica particles or alumina particles, preferably which have a positive surface charge at the pH at which the polishing occurs. The improvement in removal rate can also be observed in certain silica-based slurries, particularly those having particles with a positive (surface) charge at the pH at which polishing occurs.

For example, the method can comprise: providing a chemical mechanical polishing apparatus having a platen or carrier assembly; providing at least one substrate to be polished; providing a chemical mechanical polishing pad as disclosed herein; installing onto the platen the chemical mechanical polishing pad; optionally, providing a polishing medium (e.g. abrasive containing slurry and/or non-abrasive containing reactive liquid composition) at an interface between a polishing portion of the chemical mechanical polishing pad and the substrate; creating dynamic contact between the polishing portion of the polishing pad and the substrate, wherein at least some material is removed from the substrate. The carrier assembly can provide a controllable pressure between the substrate being polished (e.g. wafer) and the polishing pad. A polishing medium can be dispensed onto the polishing pad and drawn into the gap between the wafer and polishing layer. The polishing medium can comprise water, a pH adjusting agent, and optionally one or more of, but not limited to, the following: abrasive particles, an oxidizing agent, an inhibitor, a biocide, soluble polymers, and salts. The abrasive particle can be an oxide, metal, ceramic, or other suitably hard material. Typical abrasive particles are colloidal silica, fumed silica, ceria, and alumina. The polishing pad and substrate can rotate relative to one another. As the polishing pad rotates beneath the substrate, the substrate can sweep out a typically annular polishing track, or polishing region, wherein the wafer's surface directly confronts the polishing portion of the polishing pad. The wafer surface is polished and made planar by chemical and mechanical action of the polishing layer and polishing medium on the surface. Optionally, the polishing surface of the polishing pad can be conditioned with an abrasive conditioner before beginning polishing.

Using the pad comprising the rate enhancing lamellar particles as described here can be particularly effective in improving removal rate while avoiding defects. For example, with a slurry with positive charged particles (e.g. ceria-based slurry at pH of up to 7 or up to 6.5 or up to 6), the removal rate (e.g. tetraethyl ortho silicate (TEOS) removal rate) can be improved by 10 percent or more, 15 percent or more or 20 percent or more compared to when polishing an equivalent pad that lacks the rate enhancing lamellar particles (e.g. ZHP), while the defectivity can be reduced by 10 percent or more, 30 percent or more, or 50 percent or more.

Optionally, the pad can include a window for end-point detection. In that instance, the chemical mechanical polishing apparatus provided can further include a signal source (e.g. a light source) and a signal detector (e.g. a photosensor (preferably, a multi-sensor spectrograph). In that instance, the method can further comprise: determining a polishing endpoint by transmitting a signal (e.g. light from the light source) through the window and analyzing the signal (e.g. light) reflected off the surface of the substrate back through the endpoint detection window incident upon the sensor (e.g. photosensor). The substrate can have a metal or metallized surface, such as one containing copper or tungsten. The substrate can be a magnetic substrate, an optical substrate and a semiconductor substrate.

EXAMPLES

Materials

PTMEG polytetramethylene ether glycol blend.

Prepolymer $H_{12}$MDI/TDI-PTMEG blend having an NCO of 8.95 to 9.25 wt %. TDI (toluene diisocyanate) brand Voranate T-80™ from Dow.

$H_{12}$MDI (cycloaliphatic di-isocyanate).

MBOCA (4,4'-Methylenebis (2-chloroaniline).

Zirconium Hydrogen Phosphate powder (ZHP, 1-6 micron average particle size platelets).

Expancel™ microporous particles 551DE40d42 from Nouryon, (formerly Akzo Nobel).

Synthesis of Prepolymers

Prepolymers can be synthesized in batches, e.g. 200-1000 grams. PTMEG components are blended together to make polyol mixture. TDI and $H_{12}$MDI are mixed at 80:20 ratio before adding to polyol mixture. Enough isocyanate mixture is then added to the polyol mixture to achieve the desired NCO weight percent. The whole mixture is again mixed and then placed in a pre-heated oven at 65° C. for 4 hours before use. All samples were used the same day as synthesis. Alternatively, prepolymer $H_{12}$MDI/TDI-PTMEG blend can directly be used to make the pad.

Pad Production

The synthesized prepolymers or L-325 are heated to 65° C. Mboca is pre-weighed and melted in oven at 95° C. ZHP is added to the prepolymer to produce varying levels of lamellar particles. ZHP and prepolymer is mixed mechanically. Expancel™551DE40d42 microporous particles are then added to the prepolymer-ZHP blend. The prepolymer, ZHP and Expancel hollow microsphere blend is mixed well and degassed using vacuum. All sample had enough Expancel added to reach desired final density. After degassing MBOCA is added to the prepolymer, ZHP and Expancel blend and mixed well. The sample is then poured onto a heated plate and drawn using a polytetrafluorethyene (PTFE) coated bar with a spacer set at 175 mil. The plate is then transferred into an oven and heated to 104° C. and held at this temperature for 16 hours. The drawdown is then demolded, faced and punched down to 22 inch (55.9 cm) in diameter and used to prepare a laminated pad for polishing. All pads were 20 inch (50.8 cm) diameter with an 80 mil (0.2 cm) thick top pad, circular (30 mil depth, 20 mils width and 120 mil pitch or 0.76 mm depth, 0.51 mm width and 3 mm pitch) grooving, pressure sensitive adhesive, Suba IV sub pad, and CR-II platen adhesive. The control pad was made without ZHP additive using the similar process. Each material set was also made into plaques for property testing both with and without the Expancel filler for property testing.

Example 1

Samples of a polyurethane formulation were made according to the above procedure with varying degrees of ZHP addition. Material property summaries for the three materials are given in Table 1. While hardness or elastic modulus (G') remain within operational ranges, the tensile strength was reduced directly with the amount of addition. The functional limit for the reduction in elongation and toughness without undesirable effects on the polishing process was estimated to occur up to about 15 weight percent addition by weight.

TABLE 1

| Sample ID | Wt. % ZHP | Hardness (Shore D) ASTM D2240 | G' at 30° C. (MPa) ASTM D4065 - 20 | Tensile Strength (MPa) ASTM D412 | Toughness (MPa) ASTM D412 |
|---|---|---|---|---|---|
| Control | 0 | 66.2 | 235 | 49.7 | 96.4 |
| ZHP-5 | 5 | 68.3 | 286 | 41.7 | 68.5 |
| ZHP-10 | 10 | 68.4 | 340 | 37.5 | 51.5 |

Example 2

A pad having 10 weight percent ZHP and a pad having no ZHP were used to polish TEOS wafers using a commercially available $CeO_2$-based slurry (Asahi CES333). The slurry was prepared using manufacturer's instructions. The slurry pH was 5.5. Based on previous data, the use pH was well below the isoelectric pH of the particles being used such that particles carry at least some positive charge. Each pad was used to polish 200 mm TEOS wafers using a single set of process conditions. Polishing conditions used for each test were 93 rpm platen speed, 87 rpm wafer carrier speed, and 200 ml/min slurry flow. The polishing equipment used was an Applied Materials Mirra CMP polishing tool. Significant improvement in the polishing rate was observed with the ZHP-10 pad having a removal rate of 1930 angstroms/min as compared to 1604 angstroms/min for the pad having no ZHP. A reduction in polishing defects also was observed with an average of 62 scratch defects per wafer for the pad with no ZHP versus only 15 for the pad with 10 weight percent ZHP. These results demonstrate that the introduction of the inventive hydrogenphosphate lamellar particles into pads of the present invention was effective for increasing rate when the polishing occurs at a pH where the particles are at least partially cationic.

Example 3

Pads having 10 weight percent ZHP and pad having no ZHP were used to polish TEOS wafers using three commercially available $CeO_2$-based slurries (Hitachi H8005, Versum STI2100F, and Asahi CES333). All slurries were prepared using manufacturer's instructions. The pH during use was 5.5. Based on previous data, the use pH is well below the isoelectric pH of the particle being used such that the particles should carry at least some positive charge. Each pad was used to polish 200 mm TEOS wafers using a single set of process conditions. Polishing conditions used for each test were 93 rpm platen speed, 87 rpm wafer carrier speed, and 150 ml/min slurry flow. The polishing equipment used was an Applied Materials Mirra CMP polishing tool.

As shown in Table 2, significant enhancement in polishing rate was observed for the pad of the present invention relative to the ZHP-free reference for all slurries tested. These results demonstrated that the introduction of hydrogen phosphate additive into pads of the present invention was effective for increasing rate when the pH criteria set forth in the invention were met for multiple formulations of ceria slurries.

TABLE 2

| | | TEOS Polishing Rate (Å/min) | | |
|---|---|---|---|---|
| Sample | ZHP (wt %) | Hitachi H8005 | Versum STI2100F | Asahi CES333 |
| Control | 0 | 1163 | 1767 | 1783 |
| ZHP-10 | 10 | 1478 | 2060 | 2527 |
| % rate increase | | 27% | 17% | 42% |

Further, silicon nitride selectivity increased an average of 12% for the three slurries for the ZHP-10 pads as compared to the control pads without the ZHP.

Example 4

Pads having 10 weight percent ZHP and having no ZHP were used to polish TEOS wafers using a commercially available $CeO_2$-based slurry (Asahi CES333) and a commercial $SiO_2$-based slurry (Dow K1730). The slurries were prepared using manufacturer's instructions. The $CeO_2$ based slurry pH was 5.5 with 1 wt % solids content at use. The $SiO_2$ slurry pH was 10.5, (which is above the isoelectric pH of the slurry such that the particles do not carry a positive charge) with a 16 wt % solids content at use. Each of the four slurry/pad combinations were polished at two different polishing speeds at varying downforce, ranging from 1.5 to 4 psi. Multiple TEOS wafers were polished for each of the combinations, and the coefficient of friction during polishing was measured, as well as the removal rates.

Moreover, the experiment can be used to determine a Preston Coefficient, k, using the pressure, rate, and velocity data, by dividing the polishing rate for each sample by the product of pressure and velocity for the test. Since the two slurries used had very different solids content, an additional measure of the polishing efficiency could be determined by dividing k by the percent solids for each of the samples polished. Polishing efficiency for the $SiO_2$-based slurry was the same for both the pad with ZHP and the pad without ZHP as 0.5. Polishing efficiency for the $CeO_2$-based slurry was 4.9 for a pad without ZHP and 6.5 for a pad with ZHP.

The coefficient of friction (COF) data, calculated from the motor torque of the polishing table and the slurry temperature, provided additional insight into the improvement effected by the inventive pads. As can be seen in Table 3, all $CeO_2$-based slurry data showed significantly higher COF than the $SiO_2$-based slurry data. Moreover, the COF for the pad including ZHP was significantly higher than for the pad that did not include ZHP. This was evidence for a higher concentration of $CeO_2$ particles on the pad surface of pads comprising ZHP due to the presence of the metal hydrogenphosphate particles. As with rate, no such effect was observed when the negatively charged particle slurry (e.g. the negatively charged $SiO_2$ particles) was used.

TABLE 3

| | | Avg. COF for all pressures | |
|---|---|---|---|
| Pad | Slurry | 75 rpm | 100 rpm |
| Control (No ZHP) | $CeO_2$ | 0.46 | 0.43 |
| ZHP-10 wt % | $CeO_2$ | 0.52 | 0.49 |
| Control (No ZHP) | $SiO_2$ | 0.32 | 0.34 |
| ZHP-10 wt % | $SiO_2$ | 0.32 | 0.34 |

Example 5

Polishing was undertaken with pads with no ZHP and pads having 10 wt % ZHP and a silica based slurry at a pH above its isoelectric potential such that the particles had a negative charge. Removal rate of TEOS was about the same and up to 1.7 percent poorer on average for pads containing ZHP as compared to pads with no ZHP. SiN selectivity was twice as high for pads without ZHP than for pads with ZHP. In addition, the pads with ZHP showed substantially higher defects (scratch and chatter).

Example 6

Polishing was undertaken with pads with no ZHP and pads having 10 wt % ZHP and a silica based slurry at a pH below its isoelectric potential such that the particles had a positive charge. TEOS removal rate was 18 percent higher for the pad with ZHP than with the pad without ZHP (2278 Å/min vs. 1922 Å/min).

This disclosure further encompasses the following aspects:

Aspect 1: A polishing pad useful in chemical mechanical polishing having a polishing portion comprising a polymer matrix and rate enhancing lamellar particles that include a phosphate or an arsenate of group III-A or group IV-A metals.

Aspect 2: The polishing pad of Aspect 1 wherein the rate enhancing lamellar particles comprise material having the formula $M(HYO_4)_2n(H_2O)$, where M is a group III-A or group IV-A metal ion, Y is P or As, preferably P, and n is 0, 1, or 2.

Aspect 3: The polishing pad of Aspect 2 wherein M is $Zr^{+4}$, $Ti^{+4}$ or $Ce^{+4}$, Y is P, and n is 1.

Aspect 4: The polishing pad of any one of the previous Aspects wherein the rate enhancing lamellar particles have a layered crystalline structure.

Aspect 5: The polishing pad of any one of the previous Aspects wherein the rate enhancing lamellar particles are zirconium hydrogen phosphate.

Aspect 6: The polishing pad of any one of the previous Aspects wherein the polymer matrix comprises polyurethane, polyolefins, polyethylene, polypropylene, polyesters, polyethers, nylons, polyvinyl alcohols, polyvinyl acetates, polyacrylates, polycarbonates, polyacrylamides, polyamides, polyimides, polyether ketones, polysulfones, and fluoropolymers, copolymers thereof, or mixtures thereof, and preferably comprises polyurethane.

Aspect 7: The polishing pad of any one of the previous Aspects wherein the amount of the rate enhancing lamellar particles is least 0.1, preferably at least 1, more preferably at least 2, yet more preferably at least 3 and most preferably at least 5 and up to 20, preferably up to 15, and more preferably up to 10 weight percent based on total weight of the polishing portion.

Aspect 8: The polishing pad of any one of the previous Aspects wherein the amount of the rate enhancing lamellar particles can be 0.1 to 20 volume percent, or 1 to 18 volume percent, or 2 to 15 volume percent based on total volume of the polishing layer.

Aspect 9: The polishing pad of any one of the previous Aspects wherein the rate enhancing lamellar particles are in the form of platelets.

Aspect 10: The polishing pad of any one of the previous Aspects wherein the platelets have average dimensions of in the direction perpendicular (or substantially perpendicular) to thickness of at least 0.5, preferably at least 1, more preferably at least 2 microns, and at the same time can be up to 20, preferably up to 10, more preferably up to 7, or most preferably up to 5 microns.

Aspect 11: The polishing pad of Aspect 9 or 10 wherein the platelets have an aspect ratio of 3 to 20, preferably 3 to 10.

Aspect 12: The polishing pad of anyone of the previous Aspects wherein the polishing portion further comprises one or more microelement.

Aspect 13: The polishing pad of Aspect 12 wherein the microelement provides porosity in the polishing portion.

Aspect 14: The polishing pad of Aspect 13 wherein the one or more microelements comprise a hollow microelement.

Aspect 15: The polishing pad of Aspect 14 wherein the amount in volume percent of one or more hollow microelements is from 0 to 50, preferably from 5 to 45, and more preferably from 10 to 35 volume percent.

Aspect 16: The polishing pad of Aspect 14 or 15 wherein the microelements have a weight average diameter as measured by laser diffraction of up to 150 microns or up to 50 microns, while having a diameter of at least 10 microns.

Aspect 17: The polishing pad of any of the previous Aspects wherein the polishing portion has a density of 0.4 to 1.15, preferably 0.7 to 1.0 g/cm$^3$, as measured according to ASTM D1622 (2014).

Aspect 18: The polishing pad of any of the previous Aspects wherein the polishing portion has a Shore D hardness of 28 to 75 as measured according to ASTM D2240 (2015).

Aspect 19: The polishing pad of any of the previous Aspects wherein the polishing portion has an average thickness of 0.5-4 mm, preferably 0.7-3 mm, more preferably 1-3 mm, and yet more preferably 1.3-2.5 mm.

Aspect 20: The polishing pad of any of the previous Aspects further comprising at least one additional layer interfaced with the polishing layer.

Aspect 21: The polishing pad of Aspect 20 wherein at least one additional layer comprises a base layer.

Aspect 22: The polishing pad of Aspect 20 or 21 wherein the base layer is adhered to a back side of the polishing portion.

Aspect 23. The polishing pad of any of Aspects 20-22 wherein the base layer is compressible.

Aspect 24: The polishing pad of any of the previous Aspects wherein the volume porosity in the polishing portion can be 0 to 50, preferably 5 to 45, and more preferably 10 to 35 percent.

Aspect 25: The polishing pad of any of the previous Aspects wherein the polymer matrix comprises polyurethane.

Aspect 26: A method comprising providing a substrate, providing the polishing pad of any one of Aspects 1-25, providing a slurry between the polishing pad and the substrate, polishing the substrate with the pad and slurry.

Aspect 27: The method of Aspect 26 wherein the slurry comprises particles and wherein the polishing occurs at a pH at which at least a portion of the particles have a positive charge or a positive surface charge.

Aspect 28: The method of Aspect 26 or 27 wherein the slurry comprises cerium oxide particles.

Aspect 29: The method of Aspect 28 wherein the slurry comprises at least 0.01, preferably at least 0.1, up to 20, preferably up to 10, more preferably still, or up to 5 weight percent ceria particles based on total weight of the slurry Aspect 30: The method of any one of Aspects 26-29 wherein the slurry comprises silicon oxide particles.

Aspect 31: The method of any one of Aspects 26-30 wherein the polishing pad is on a platen and pressure of the platen is 6-35, preferably 10-30 kilopascals (kPa).

Aspect 32: The method of Aspect 31 wherein speed of the platen is 40 to 100, preferably 50-90 rpm.

Aspect 33: The method of any one of Aspects 26-32 wherein pH of the slurry during polishing is 2-7, preferably 2.5-6.8.

The compositions, methods, and articles can alternatively comprise, consist of, or consist essentially of, any appropriate materials, steps, or components herein disclosed. The compositions, methods, and articles can additionally, or alternatively, be formulated so as to be devoid, or substantially free, of any materials (or species), steps, or components, that are otherwise not necessary to the achievement of the function or objectives of the compositions, methods, and articles.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %,"

etc.). Moreover, stated upper and lower limits can be combined to form ranges (e.g. "at least 1 or at least 2 weight percent" and "up to 10 or 5 weight percent" can be combined as the ranges "1 to 10 weight percent", or "1 to 5 weight percent" or "2 to 10 weight percent" or "2 to 5 weight percent"). "Combinations" is inclusive of blends, mixtures, alloys, reaction products, and the like. The terms "first," "second," and the like, do not denote any order, quantity, or importance, but rather are used to distinguish one element from another. The terms "a" and "an" and "the" do not denote a limitation of quantity and are to be construed to cover both the singular and the plural, unless otherwise indicated herein or clearly contradicted by context. "Or" means "and/or" unless clearly stated otherwise. Reference throughout the specification to "some embodiments", "an embodiment", and so forth, means that a particular element described in connection with the embodiment is included in at least one embodiment described herein, and may or may not be present in other embodiments. In addition, it is to be understood that the described elements may be combined in any suitable manner in the various embodiments. A "combination thereof" is open and includes any combination comprising at least one of the listed components or properties optionally together with a like or equivalent component or property not listed.

Unless specified to the contrary herein, all test standards are the most recent standard in effect as of the filing date of this application, or, if priority is claimed, the filing date of the earliest priority application in which the test standard appears.

What is claimed is:

1. A polishing pad useful in chemical mechanical polishing having a polishing portion comprising a polymer matrix and lamellar particles for enhancing polishing rate, the lamellar particles having the formula M(HYO4)2n(H20), where M is Zr*4, Ti*4 or Ce*4, Y is P or As, and n is 0, 1, or 2 and wherein the lamellar particles have an alternating crystalline structure of FIG. 1 that cleaves into platelets.

2. The polishing pad of claim 1 wherein the lamellar particles are zirconium hydrogen phosphate particles.

3. The polishing pad of claim 1 wherein the polymer matrix comprises polyurethane, polyolefins, polyethylene, polypropylene, polyesters, polyethers, nylons, polyvinyl alcohols, polyvinyl acetates, polyacrylates, polycarbonates, polyacrylamides, polyamides, nylon, polyimides, polyether ketones, polysulfones, and fluoropolymers, copolymers thereof, or mixtures thereof.

4. A polishing pad useful in chemical mechanical polishing having a polishing portion comprising a polyurethane matrix and lamellar zirconium hydrogen phosphate particles for enhancing polishing rate, the lamellar particles are 0.1 to 20 weight percent based on total weight of the polishing layer and wherein the lamellar particles have an average length of 0.5 to 20 microns and wherein the lamellar particles have an alternating crystalline structure of FIG. 1 that cleaves into platelets.

5. The polishing pad of claim 4 wherein the amount of the lamellar particles are 2 to 15 weight percent based on total weight of the polishing layer.

6. The polishing pad of claim 4 wherein the lamellar particles have a length to width ratio of 3 to 20.

7. The polishing pad of claim 4 wherein the polishing pad is non-porous.

8. The polishing pad of claim 4 wherein the polishing layer includes 5 to 45 volume percent porosity.

* * * * *